US008525741B2

(12) United States Patent
Lee et al.

(10) Patent No.: US 8,525,741 B2
(45) Date of Patent: Sep. 3, 2013

(54) MULTI-LOOP ANTENNA SYSTEM AND ELECTRONIC APPARATUS HAVING THE SAME

(75) Inventors: Cheng-Tse Lee, Taipei (TW); Saou-Wen Su, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 346 days.

(21) Appl. No.: 13/074,159

(22) Filed: Mar. 29, 2011

(65) Prior Publication Data

US 2012/0056790 A1 Mar. 8, 2012

(30) Foreign Application Priority Data

Sep. 6, 2010 (CN) ..... 2010 1 0274841

(51) Int. Cl.
*H01Q 21/30* (2006.01)

(52) U.S. Cl.
USPC ..... 343/702; 343/867

(58) Field of Classification Search
USPC ..... 343/702, 867
See application file for complete search history.

(56) References Cited

U.S. PATENT DOCUMENTS

| | | | | |
|---|---|---|---|---|
| 8,344,950 | B2 * | 1/2013 | Su | 343/700 MS |
| 2002/0018021 | A1 * | 2/2002 | Koyanagi et al. | 343/702 |
| 2010/0271271 | A1 * | 10/2010 | Wu | 343/702 |
| 2012/0038519 | A1 * | 2/2012 | Su | 343/702 |

* cited by examiner

*Primary Examiner* — Allyson Trail
(74) *Attorney, Agent, or Firm* — Rosenberg, Klein & Lee

(57) ABSTRACT

A multi-loop antenna system includes: a plurality of loop antennas disposed on a substrate and arranged such that each of extending lines extending respectively from geometric centers of the loop antennas to a center point that is bounded by the loop antennas has a predetermined length, and that each of the loop antennas is spaced apart from an adjacent one of the same by a predetermined distance; and a system module facing toward and being spaced apart from and parallel to the substrate such that the grounding plane is able to reflect radiation from the loop antennas. Each of the loop antennas includes first and second radiator portions operable in respective frequency bands; the former having opposite ends that respectively serve as signal-feed and grounding sections; the latter having opposite ends that are connected respectively to the signal-feed and grounding sections.

15 Claims, 10 Drawing Sheets

MULTI-LOOP ANTENNA SYSTEM AND ELECTRONIC APPARATUS HAVING THE SAME

CROSS-REFERENCE TO RELATED APPLICATION

This application claims priority of Chinese Application No. 201010274841.3, filed on Sep. 6, 2010.

BACKGROUND OF THE INVENTION

1. Field of the Invention

The present invention relates to an antenna system and an electronic apparatus having the same, more particularly to a multi-loop antenna system and an electronic apparatus having the same.

2. Description of the Related Art

Conventionally, planar inverted-F antennas are used in wireless devices, such as wireless access points. Taiwanese Patent No. M377714 discloses a monopole antenna system, which includes three monopole antennas that are formed on a grounding plane by cutting or punching techniques, and which is applicable to multiple-input-multiple-output wireless communications.

Although such an antenna system may be disposed in a housing of an electronic apparatus, the antenna system, however, has a three-dimensional structure and hence occupies a larger space, which consequently reduces space in the housing available for disposing of other electronic components. Furthermore, such an antenna system generally has gain values ranging from 3 dBi to 5 dBi in the 2.4 GHz and 5 GHz frequency bands, and radiation patterns thereof generally show lower directivity.

SUMMARY OF THE INVENTION

Therefore, an object of the present invention is to provide a multi-loop antenna system capable of alleviating the aforesaid drawbacks of the antenna system of the prior art.

Accordingly, a multi-loop antenna system of the present invention includes an antenna module and a system module. The antenna module includes a substrate, and a plurality of loop antennas. The loop antennas are disposed on the substrate, and are arranged such that each of extending lines extending respectively from geometric centers of the loop antennas to a center point that is bounded by the loop antennas has a predetermined length, and that each of the loop antennas is spaced apart from an adjacent one of the loop antennas by a predetermined minimum distance. Each of the loop antennas includes: a first radiator portion operable in a first frequency band, and having opposite ends that respectively serve as a signal-feed section and a grounding section, and that are adjacent to and spaced apart from each other such that the first radiator portion substantially forms a loop; and a second radiator portion operable in a second frequency band, and having opposite ends that are connected electrically and respectively to the signal-feed section and the grounding section of the first radiator portion, such that the second radiator portion substantially forms a loop. The system module has a grounding plane that faces toward and that is spaced apart from and parallel to the substrate such that the grounding plane is able to reflect radiation from the antenna module so as to enhance gain and directivity thereof.

Another object of the present invention is to provide an electronic apparatus having an antenna module and a system module.

Accordingly, an electronic apparatus of the present invention includes a housing, and an antenna module and a system module disposed in the housing. The antenna module includes a substrate, and a plurality of loop antennas. The loop antennas are disposed on the substrate, and are arranged such that each of extending lines extending respectively from geometric centers of the loop antennas to a center point that is bounded by the loop antennas has a predetermined length, and that each of the loop antennas is spaced apart from an adjacent one of the loop antennas by a predetermined distance. Each of the loop antennas includes: a first radiator portion operable in a first frequency band, and having opposite ends that respectively serve as a signal-feed section and a grounding section, and that are adjacent to and spaced apart from each other such that the first radiator portion substantially forms a loop; and a second radiator portion operable in a second frequency band, and having opposite ends that are connected electrically and respectively to the signal-feed section and the grounding section of the first radiator portion, such that the second radiator portion substantially forms a loop. The system module has a grounding plane that faces toward and that is spaced apart from and parallel to the substrate such that the grounding plane is able to reflect radiation from the antenna module so as to enhance gain and directivity of the multi-loop antenna system.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
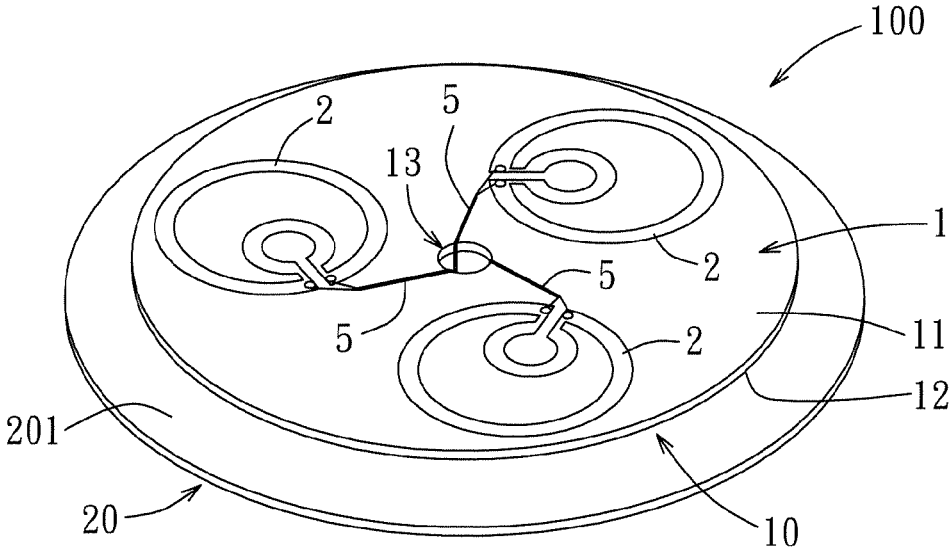
FIG. 1 is a perspective view of the first preferred embodiment of a multi-loop antenna system according to the present invention.

Before the present invention is described in greater detail, it should be noted that like elements are denoted by the same reference numerals throughout the disclosure.

Referring to FIG. 1, the first preferred embodiment of a multi-loop antenna system 100 of the present invention is operable in the wireless local area network frequency bands, which range from 2400 MHz to 2484 MHz and from 5150 MHz to 5825 MHz, respectively, and includes an antenna module 10 and a system module 20. The antenna module 10 includes a substrate 1 and a plurality of loop antennas 2. The substrate 1 is preferably made of a dielectric material, such as glass fiber (FR4), has opposite first and second surfaces 11, 12, and is formed with a through-hole 13 for extensions of cables 5 therethrough.

Figure 2:
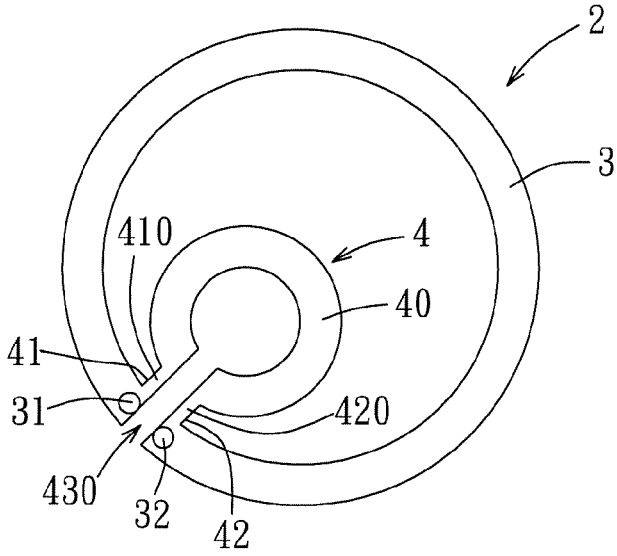
FIG. 2 is a schematic diagram to illustrate a loop antenna of the multi-loop antenna system.

Referring to FIG. 2, in this embodiment, each of the loop antennas 2 is a one-wavelength loop antenna made of metal, is disposed on the first surface 11 of the substrate 1, and includes first and second radiator portions 3, 4.

The first radiator portion 3 of each of the loop antennas 2 is operable in a first frequency band preferably ranging from 2400 MHz to 2484 MHz, and has opposite ends that respectively serve as a signal-feed section 31 and a grounding section 32, and that are adjacent to and spaced apart from each other such that the first radiator portion 3 substantially forms a circular loop. The second radiator portion 4 of each of the loop antennas 2 is operable in a second frequency band preferably ranging from 5150 MHz to 5825 MHz, and has opposite ends 41, 42 that are connected electrically and respectively to the signal-feed section 31 and the grounding section 32 of the first radiator portion 3 of the loop antenna 2, such that the second radiator portion 4 substantially forms a circular loop.

In this embodiment, the second radiator portion 4 has a substantially circular loop-shaped radiator section 40 having opposite ends, and a pair of parallel extending sections 410, 420 extending from the opposite ends of the radiator section 40 and serving as the opposite ends 41, 42 of the second radiator portion 4, respectively. The pair of extending sections 410, 420 and the radiator section 40 cooperate to define a slot 430.

Figure 3:
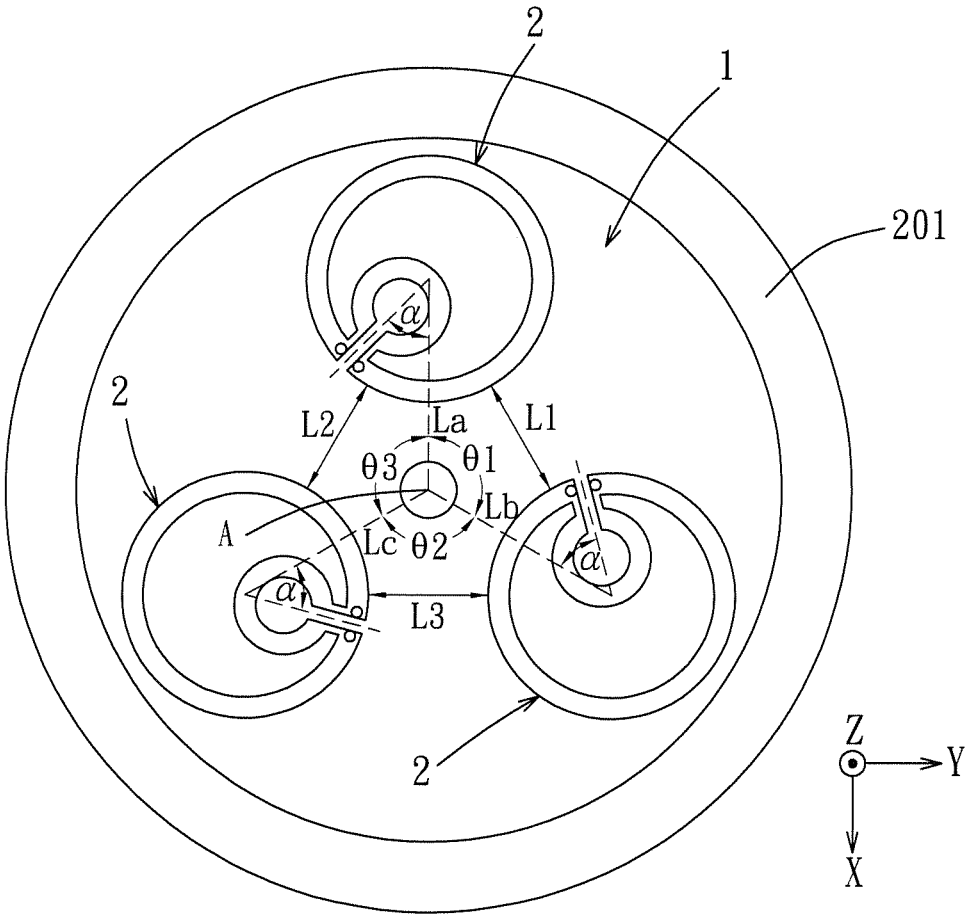
FIG. 3 is a schematic diagram to illustrate the multi-loop antenna system.

Referring to FIG. 3, the loop antennas 2 are arranged along a peripheral portion of the substrate such that each of extending lines extending respectively from geometric centers of the loop antennas 2 to a center point "A" that is bounded by the loop antennas 2 has a predetermined length. That is to say, lengths "La", "Lb", and "Lc" are identical to one another. Moreover, each of the loop antennas 2 is spaced apart from an adjacent one of the loop antennas 2 by a predetermined minimum distance. That is to say, distances "L1", "L2", and "L3" are identical to one another. Furthermore, each of the extending lines forms a predetermined angle with an adjacent one of the extending angles. That is to say, "θ1", "θ2", and "θ3" are identical to one another and are equal to 120 degrees in this embodiment. Such a symmetrical arrangement of the loop antennas 2 ensures substantially equal degrees of isolation there among and a relatively symmetrical radiation coverage.

It is worth noting that, in this embodiment, the through-hole 13 corresponds in position to the center point "A", and the cables 5 are connected electrically and respectively to the loop antennas 2 via the through-hole 13 so as to avoid overlapping of the loop antennas 2 by the cables 5, thereby reducing interference between the cables 5 and the loop antennas 2.

In this embodiment, for each of the loop antennas 2, the first radiator portion 3 substantially encloses the second radiator portion 4. Such a configuration of the second radiator portion 4 with respect to the first radiator portion 3 ensures efficient usage of space. Specifically, the geometric center of each of the loop antennas 2 is bounded by the first radiator portion 3 instead of the second radiator portion 4 of the loop antenna 2. In this embodiment, for each of the loop antennas 2, the slot 430 opens in a direction that forms a predetermined included angle "a" with the respective one of the extending lines, and the first and second radiator portions 3, 4 are respectively symmetrical in the direction in which the slot 430 opens. The predetermined included angle "a" is preferably 45 degrees such that signals radiated by each of the loop antennas 2 are characterized by bipolar propagation in a direction perpendicular to the first surface 11 of the substrate 1.

Figure 4:
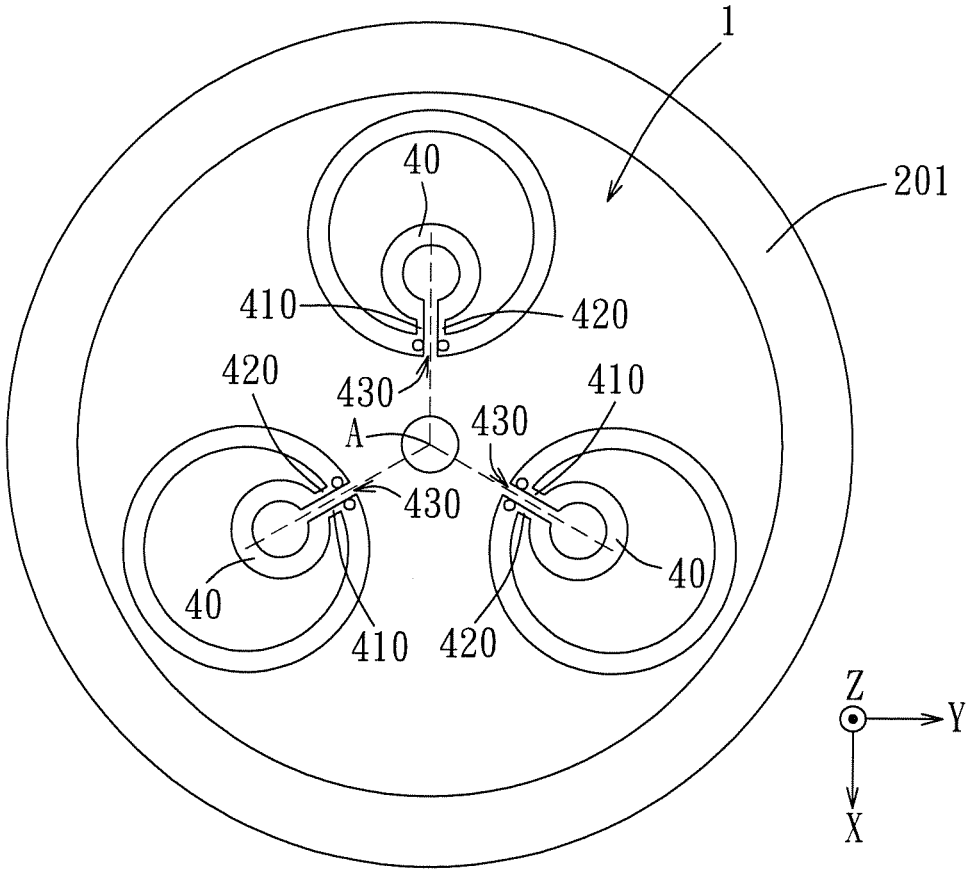
FIG. 4 is a schematic diagram to illustrate a modification of the multi-loop antenna system according to the present invention.
Figure 5:
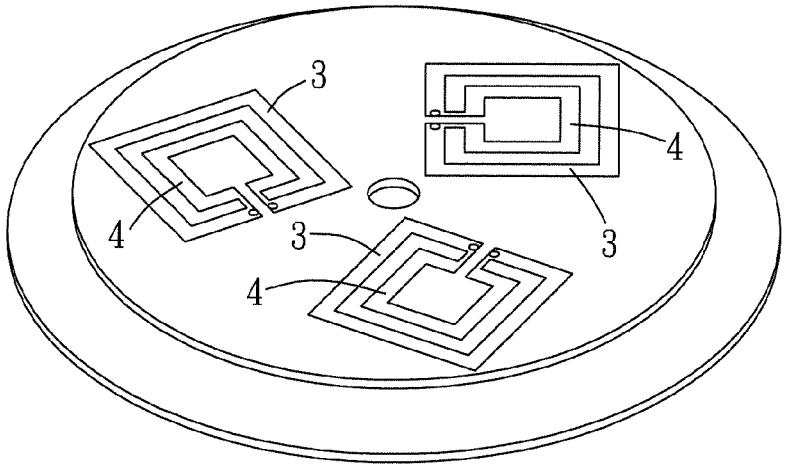
FIG. 5 is a perspective view of another modification of the multi-loop antenna system according to the pre sent invention.

However, referring to FIG. 4, in a modification, the pair of the extending sections 410, 420 and the radiator section 40 of the second radiator portion 4 of each of the loop antennas 2 may be configured such that the slot 430 opens toward the center point "A". Furthermore, referring to FIG. 5, in another modification, each of the first and second radiator portions 3, 4 of each of the loop antennas 2 may be a rectangular radiator portion.

In this embodiment, the system module 20 is a system circuit board having a grounding plane 201 that faces toward and that is spaced apart from and parallel to the second surface 12 of the substrate 1 such that the grounding plane 201 is able to reflect radiation from the antenna module 10. Radiation patterns of the multi-loop antenna system 100 thus exhibit high directivity and gain. Moreover, the system module 20 preferably has a multi-layer structure, of which the top layer is a thin metal layer serving as the grounding plane 201, and each of remaining layers is independently one of a substrate layer and a circuit layer. It is to be noted that, in other embodiments, the antenna module 10 and the system module 20 may be spaced apart from each other by a distance not smaller than 5 mm (e.g., 8.4 mm) so as to enable disposing of various electronic components therebetween. Furthermore, the substrate 1 occupies an area not larger than that occupied by the system module 20 such that the system module 20 is able to substantially reflect signals radiated by the antenna module 10.

Figure 6:
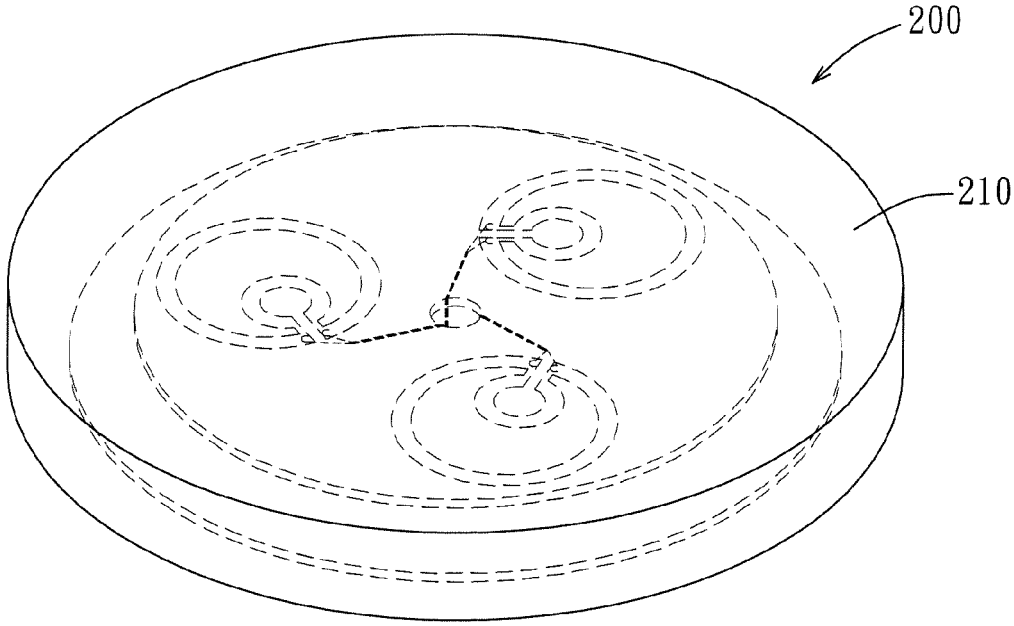
FIG. 6 is a perspective view of an electronic apparatus including a housing and the multi-loop antenna system, which is disposed in the housing, according to the present invention.

Referring to FIG. 6, the multi-loop antenna system 100 of the first preferred embodiment may be disposed in a housing 210 of an electronic apparatus 200, which may be a wireless access point or a wireless router.

Each of the cables 5 is preferably a mini-coaxial cable connected electrically to the feed-in segment 31 of the respective loop antenna 2 for transmission and reception of signals therethrough.

Figure 7:
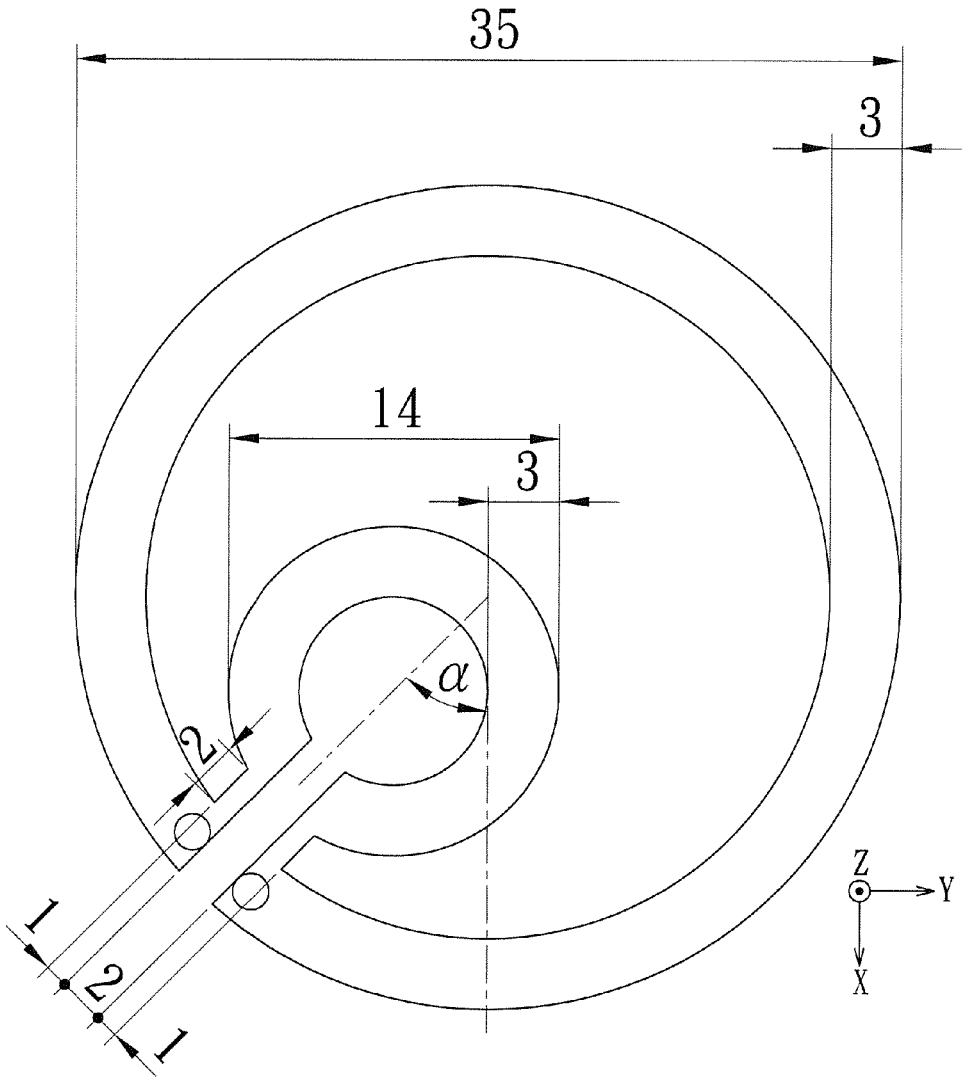
FIG. 7 is a schematic diagram to illustrate dimensions of the loop antenna of the multi-loop antenna system.
Figure 8:
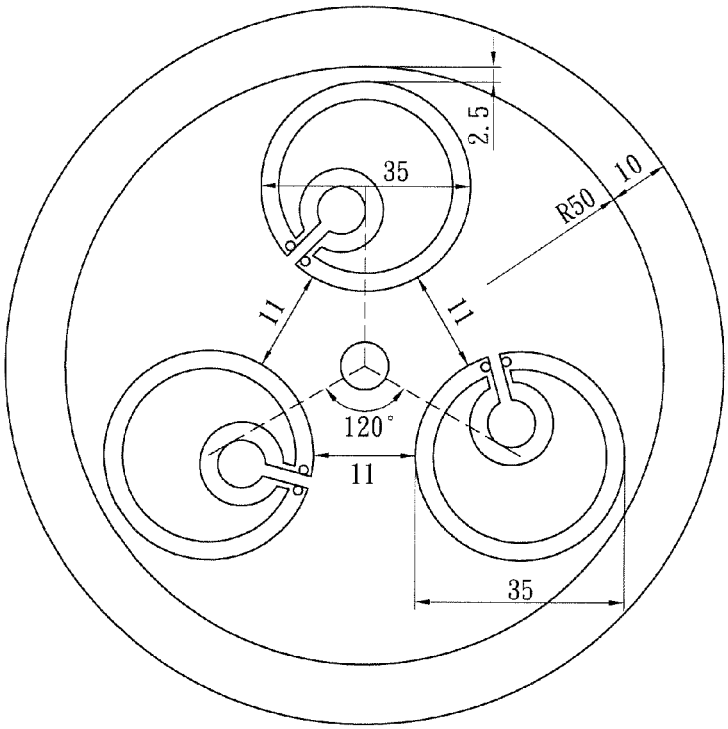
FIG. 8 is a schematic diagram to illustrate dimensions of the multi-loop antenna system.
Figure 9:
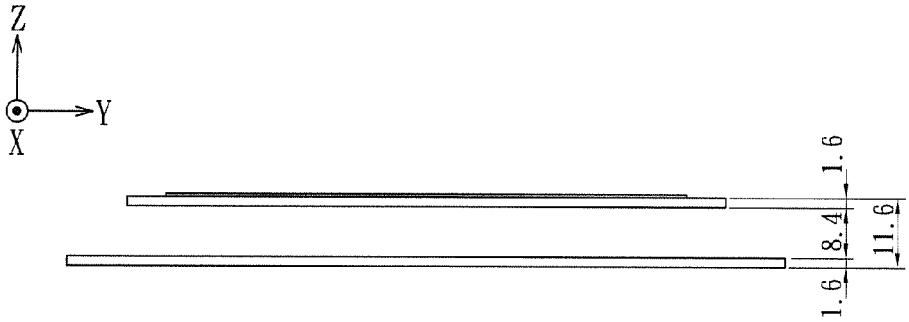
FIG. 9 is a schematic diagram to illustrate dimensions of the multi-loop antenna system when viewed from the side.

FIGS. 7 to 9 show dimensions of the multi-loop antenna system 100 in millimeters. However, configuration of the multi-loop antenna system 100 is not limited to such.

Figure 10:
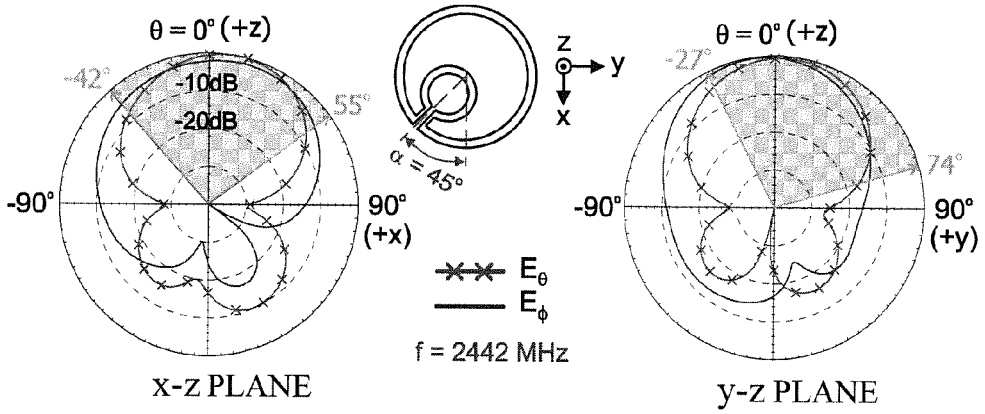
FIG. 10 shows radiation patterns of the multi-loop antenna system in the x-z and y-z planes when operated at 2442 MHz.
Figure 11:
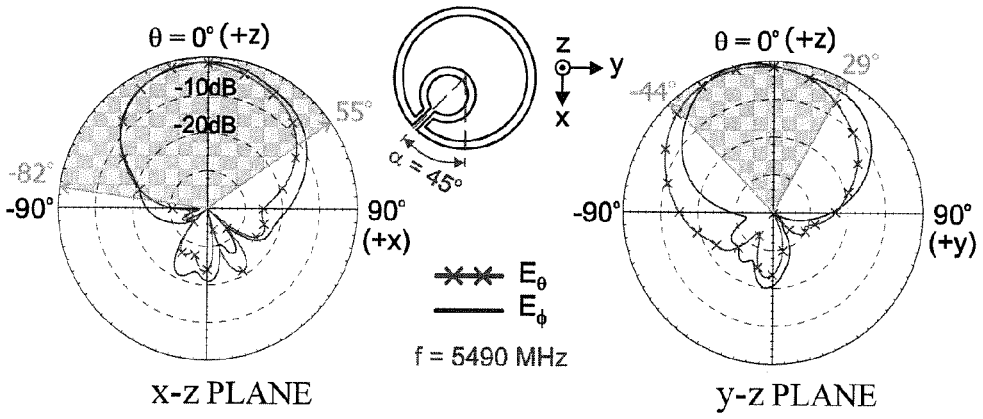
FIG. 11 shows radiation patterns of the multi-loop antenna system in the x-z and y-z planes when operated at 5490 MHz.

FIGS. 10 and 11 show two-dimensional radiation patterns of the first and second radiator portions 3, 4 at 2442 MHz and 5490 MHz, respectively. It is apparent that the multi-loop antenna system 100 is characterized by high directivity and bipolar propagation in the direction perpendicular to the first surface 11.

Figure 12:
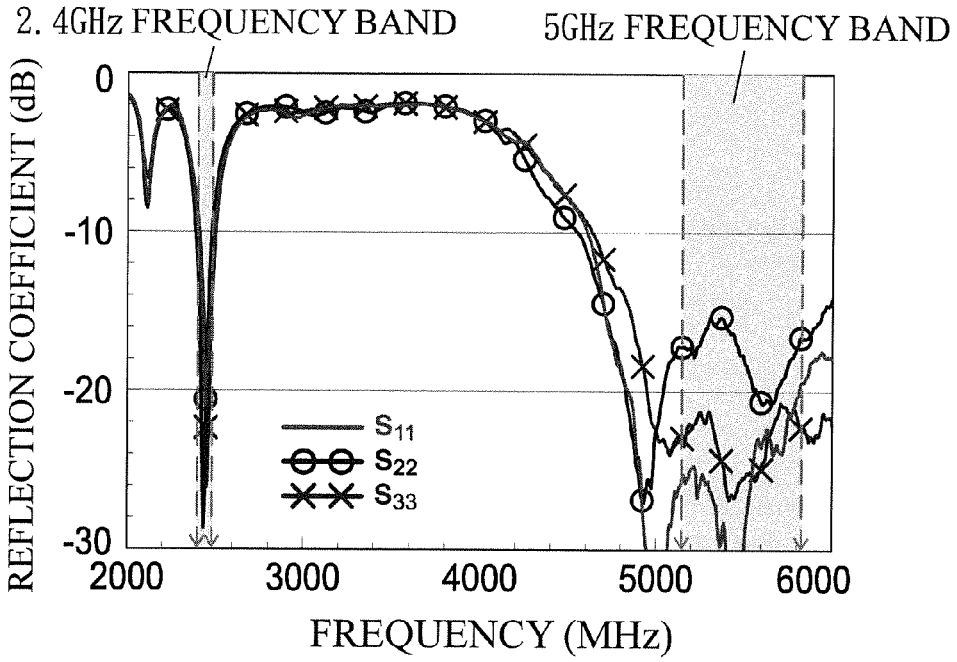
FIG. 12 is a plot of reflection coefficient of the multi-loop antenna system.

FIG. 12 shows a plot of reflection coefficient, of which "$S_{11}$", "$S_{22}$", and "$S_{33}$" represent reflection coefficients of the loop antennas 2, respectively. It is apparent that the reflection coefficients of the loop antennas 2 are lower than −10 dB in the first and second frequency bands.

Figure 13:
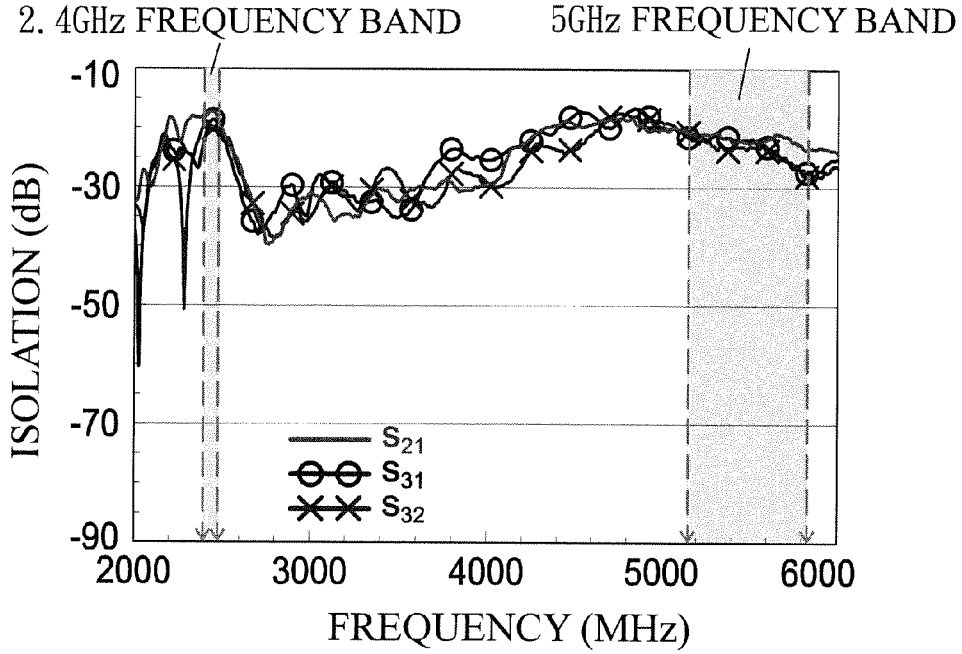
FIG. 13 is a plot of isolation of the multi-loop antenna system.

FIG. 13 shows a plot of isolation, of which "$S_{21}$", "$S_{32}$", and "$S_{32}$" represent isolations between different pairs of the loop antennas 2, respectively. It is apparent that an average value of the isolations among the loop antennas 2 is below −15 dB.

Figure 14:
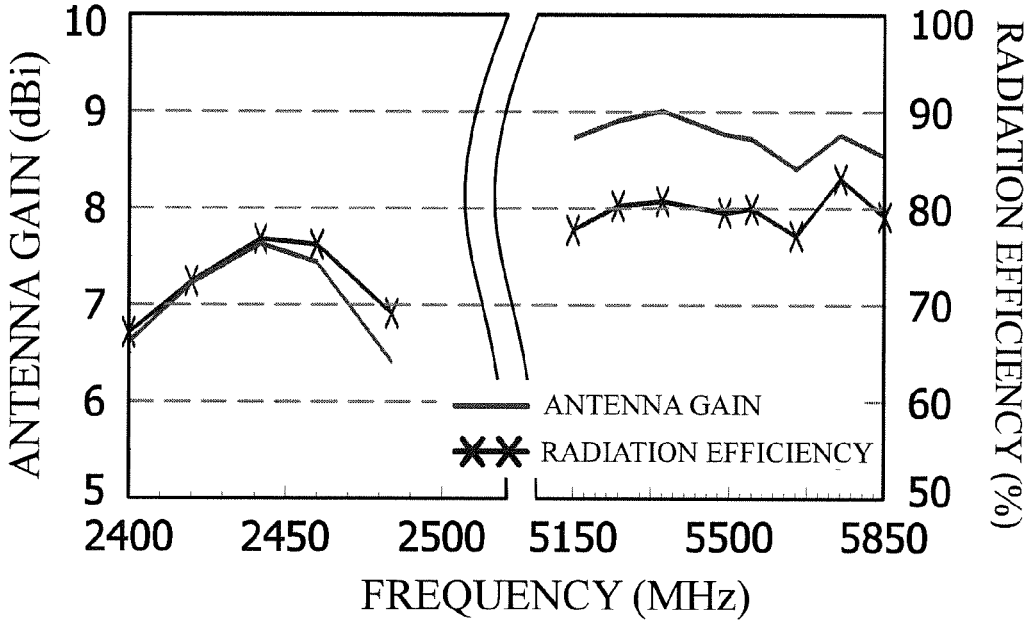
FIG. 14 is a plot showing gain value and radiation efficiency of the multi-loop antenna system at different frequencies.

FIG. 14 shows a plot of radiation efficiency of the multi-loop antenna system 100. It is apparent that the multi-loop antenna system 100 has a maximum gain of 7.6 dBi and a radiation efficiency of 76% in the first frequency band, and a maximum gain of 9 dBi and a radiation efficiency of 83% in the second frequency band.

Figure 15:
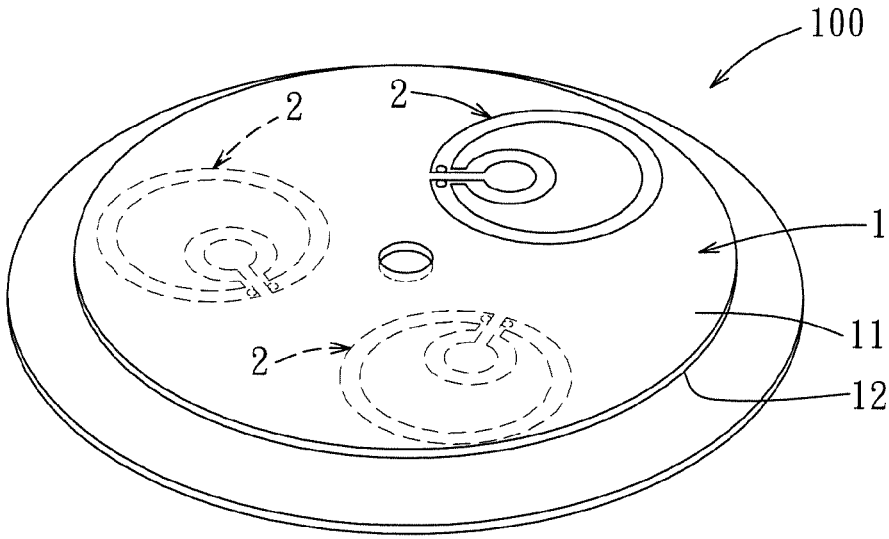
FIG. 15 is a perspective view of the second preferred embodiment of a multi-loop antenna system according to the present invention.

FIG. 15 shows the second preferred embodiment of a multi-loop antenna system 100 according to the present invention, of which the loop antennas 2 are disposed on both the first and second surfaces 11, 12 of the substrate 1.

Figure 16:
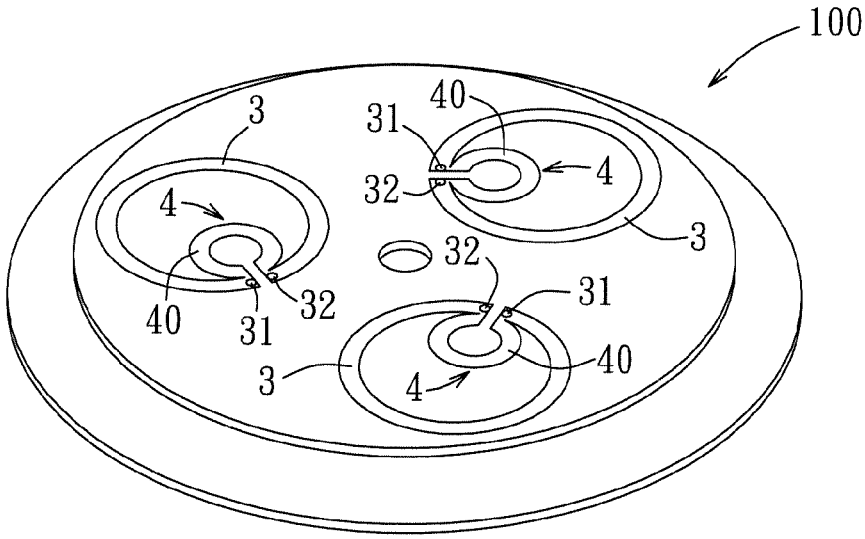
FIG. 16 is a perspective view of the third preferred embodiment of a multi-loop antenna system according to the present invention.

FIG. 16 shows the third preferred embodiment of a multi-loop antenna system 100 according to the present invention. The sole difference between the first and third preferred embodiments resides in that the second radiator portion 4 of each of the loop antennas 2 includes only the radiator section 40, and that the opposite ends of the radiator section 40 serve as the opposite ends 41, 42 of the second radiator portion 4.

In summary, the multi-loop antenna system 100 is applicable to multiple-input-multiple-output communications, is operable in the wireless local area network frequency bands, radiates signals with high directivity, and is characterized by relatively high isolation. In addition, because printed circuit board techniques are used to form the loop antennas 2, fabrication is relatively easy and costs less, and the multi-loop antenna system 100 has a low-profile of planar configuration suitable for application to small outdoor wireless devices.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A multi-loop antenna system comprising:

an antenna module including a substrate, and a plurality of loop antennas disposed on said substrate, and arranged such that each of extending lines extending respectively from geometric centers of said loop antennas to a center point that is bounded by said loop antennas has a predetermined length, and that each of said loop antennas is spaced apart from an adjacent one of said loop antennas by a predetermined minimum distance, each of said loop antennas including a first radiator portion operable in a first frequency band, and having opposite ends that respectively serve as a signal-feed section and a grounding section, and that are adjacent to and spaced apart from each other such that said first radiator portion substantially forms a loop, and a second radiator portion operable in a second frequency band, and having opposite ends that are connected electrically and respectively to said signal-feed section and said grounding section of said first radiator portion, such that said second radiator portion substantially forms a loop; and a system module having a grounding plane that faces toward and that is spaced apart from and parallel to said substrate such that said grounding plane is able to reflect radiation from said antenna module.

2. The multi-loop antenna system as claimed in claim 1, wherein:

said substrate has opposite first and second surfaces, said loop antennas being disposed on said first and second surfaces; and said grounding plane of said system module faces toward and is spaced from and parallel to said second surface.

3. The multi-loop antenna system as claimed in claim 1, wherein:

said substrate has opposite first and second surfaces, said loop antennas being disposed on said first surface; and said grounding plane of said system module faces toward and is spaced from and parallel to said second surface.

4. The multi-loop antenna system as claimed in claim 1, wherein, for each of said loop antennas, said first radiator portion substantially encloses said second radiator portion.

5. The multi-loop antenna system as claimed in claim 1, wherein said loop antennas are further arranged such that each of said extending lines forms a predetermined angle with an adjacent one of said extending lines.

6. The multi-loop antenna system as claimed in claim 1, wherein said second radiator portion includes a substantially loop-shaped radiator section having opposite ends, and a pair of extending sections extending from said opposite ends of said radiator section and serving as said opposite ends of said second radiator portion, respectively.

7. The multi-loop antenna system as claimed in claim 6, wherein said pair of extending sections and said radiator section cooperate to define a slot that opens in a direction that forms a predetermined included angle with the respective one of said extending lines.

8. The multi-loop antenna system as claimed in claim 6, wherein said pair of extending sections and said radiator section cooperate to define a slot that opens toward said center point.

9. The multi-loop antenna system as claimed in claim 1, wherein said second radiator portion includes a substantially loop-shaped radiator section having opposite ends serving as said opposite ends of said second radiator portion, respectively.

10. The multi-loop antenna system as claimed in claim 9, wherein said radiator section defines a slot that opens in a direction that forms a predetermined included angle with the respective one of said extending lines.

11. The multi-loop antenna system as claimed in claim 9, wherein said radiator section defines a slot that opens toward said center point.

12. The multi-loop antenna system as claimed in claim 1, wherein each of said first and second radiator portions has a shape independently selected from a rectangular loop and a circular loop.

13. The multi-loop antenna system as claimed in claim 1, wherein said substrate is formed with a through-hole corresponding in position to said center point so as to permit extension of cables therethrough.

14. The multi-loop antenna system as claimed in claim 1, wherein said substrate occupies an area not larger than that occupied by said system module.

15. An electronic apparatus comprising a housing, and an antenna module and a system module disposed in said housing;

said antenna module including a substrate, and a plurality of loop antennas disposed on said substrate, and arranged such that each of extending lines extending respectively from geometric centers of said loop antennas to a center point that is bounded by said loop antennas has a predetermined length, and that each of said loop antennas is spaced apart from an adjacent one of said loop antennas by a predetermined minimum distance, each of said loop antennas including a first radiator portion operable in a first frequency band, and having opposite ends that respectively serve as a signal-feed section and a grounding section, and that are adjacent to and spaced apart from each other such that said first radiator portion substantially forms a loop, and a second radiator portion operable in a second frequency band, and having opposite ends that are connected electrically and respectively to said signal-feed section and said grounding section of said first radiator portion, such that said second radiator portion substantially forms a loop;

said system module having a grounding plane that faces toward and that is spaced apart from and parallel to said substrate such that said grounding plane is able to reflect radiation from said antenna module.

* * * * *